US009052073B2

(12) United States Patent
Wang et al.

(10) Patent No.: US 9,052,073 B2
(45) Date of Patent: Jun. 9, 2015

(54) ASSEMBLY STRUCTURE OF LIGHT-GUIDING COVER AND LIGHTING DEVICE USING THE SAME

(71) Applicant: LEOTEK Electronics Corporation, Taoyuan Hsien (TW)

(72) Inventors: Shih-Chang Wang, Taoyuan Hsien (TW); Po-Chang Li, Taoyuan Hsien (TW); Ming-Chih Lai, Taoyuan Hsien (TW); Pin-Hao Hsu, Taoyuan Hsien (TW)

(73) Assignee: Lite-On Technology Corporation (CN)

( * ) Notice: Subject to any disclaimer, the term of this patent is extended or adjusted under 35 U.S.C. 154(b) by 92 days.

(21) Appl. No.: 13/886,583

(22) Filed: May 3, 2013

(65) Prior Publication Data

US 2014/0254149 A1 Sep. 11, 2014

(30) Foreign Application Priority Data

Mar. 8, 2013 (TW) ..... 102108171 A

(51) Int. Cl.

| | |
|---|---|
| ***F21V 1/14*** | (2006.01) |
| ***F21S 6/00*** | (2006.01) |
| ***F21S 8/08*** | (2006.01) |
| ***F21V 7/00*** | (2006.01) |
| ***F21V 7/05*** | (2006.01) |

(Continued)

(52) U.S. Cl.

CPC . *F21S 6/002* (2013.01); *F21V 1/14* (2013.01); *F21S 8/085* (2013.01); *F21V 7/0016* (2013.01); *F21V 7/005* (2013.01); *F21V 7/0083* (2013.01); *F21V 7/05* (2013.01); *F21V 11/12* (2013.01); *F21V 17/164* (2013.01); *F21W 2131/103* (2013.01); *F21Y 2101/02* (2013.01); *F21Y 2105/001* (2013.01)

(58) Field of Classification Search

CPC ..... F21V 1/14
USPC ..... 362/235, 311.14, 248, 290, 249.02
See application file for complete search history.

(56) References Cited

U.S. PATENT DOCUMENTS

| | | | | |
|---|---|---|---|---|
| 8,814,388 | B2 * | 8/2014 | Hsu | 362/249.02 |
| 2010/0277906 | A1 * | 11/2010 | Choi et al. | 362/235 |

(Continued)

FOREIGN PATENT DOCUMENTS

| | | |
|---|---|---|
| CN | 201547684 | 8/2010 |
| TW | 532458 | 5/2003 |
| WO | WO 2011143184 | 11/2011 |

*Primary Examiner* — Anabel Ton
(74) *Attorney, Agent, or Firm* — The Farrell Law Firm, P.C.

(57) ABSTRACT

An assembly structure of light-guiding cover is used in a lighting device. The lighting device comprises a light-emitting element. The assembly structure comprises a casing and a light-guiding cover. The casing has a receiving recess and a first engaging groove and a second engaging groove opposite to the first engaging groove, the light-emitting element is disposed within the receiving recess, and the first engaging groove and the second engaging groove are located at opposite two sides of the receiving recess. The light-guiding cover covers the receiving recess and has at least one aperture corresponding to the light-emitting element, wherein the light-guiding cover comprises a first engaging sheet and a second engaging sheet. The first engaging sheet is engaged with the first engaging groove. The second engaging sheet is disposed opposite to the first engaging sheet and engaged with the second engaging groove.

16 Claims, 3 Drawing Sheets

(51) Int. Cl.

| | |
|---|---|
| ***F21V 11/12*** | (2006.01) |
| ***F21V 17/16*** | (2006.01) |
| *F21W 131/103* | (2006.01) |
| *F21Y 101/02* | (2006.01) |
| *F21Y 105/00* | (2006.01) |

(56) References Cited

U.S. PATENT DOCUMENTS

| | | | | |
|---|---|---|---|---|
| 2013/0128581 | A1* | 5/2013 | Hsu | 362/249.02 |
| 2013/0155673 | A1* | 6/2013 | Wang et al. | 362/235 |

* cited by examiner

ASSEMBLY STRUCTURE OF LIGHT-GUIDING COVER AND LIGHTING DEVICE USING THE SAME

PRIORITY

This application claims the benefit of Taiwan application Serial No. 102108171, filed Mar. 8, 2013, the subject matter of which is incorporated herein by reference.

BACKGROUND OF THE INVENTION

1. Field of the Invention

The invention relates in general to an assembly structure, and more particularly to an assembly structure of light-guiding cover and a lighting device using the same.

2. Description of the Related Art

Convention lighting device, such as a street lamp disposed near to a street, comprises a lamp bulb or a lamp tube. With development of light-emitting diode (LED), LED is substituted for the convention street lamp using the lamp bulb or the lamp tube because of the advantages of high efficiency, high anti-seismic, high color rendering and long life for LED. However, although LED has above advantages, LED is easy to light a non-expected region because of a large light-emitting angle. Especially, for the street lamp disposed between the street and a building, light emitted from the street lamp which is possible to affect residents within the building is designed to avoid lighting the building near to the street. In general, the lighting region of the lighting device using LED can be changed through assembling a light-guiding cover. However, for the street lamp, assembling the light-guiding cover must be executed in an aerial position, and thus the danger and the difficulty of assembling the light-guiding cover is increased.

SUMMARY OF THE INVENTION

The invention is directed to an assembly structure of light guiding cover and a lighting device using the same. In an embodiment, a light-guiding cover of the lighting device can be replaced rapidly, and thus the difficulty and danger of replacing light-guiding cover can be reduced.

According to an embodiment of the present invention, an assembly structure of light guiding cover is provided. The assembly structure of light-guiding cover is used in a lighting device. The lighting device comprises a light-emitting element. The assembly structure of light-guiding cover comprises a casing and a light-guiding cover. The casing has a receiving recess and a first engaging groove and a second engaging groove opposite to the first engaging groove, the light-emitting element is disposed within the receiving recess, and the first engaging groove and the second engaging groove are located at opposite two sides of the receiving recess. The light-guiding cover covers the receiving recess and has at least one aperture corresponding to the light-emitting element, wherein the light-guiding cover comprises a first engaging sheet and a second engaging sheet. The first engaging sheet is engaged with the first engaging groove. The second engaging sheet is disposed opposite to the first engaging sheet and engaged with the second engaging groove.

According to another embodiment of the present invention, a lighting device is provided. The lighting device comprises a light-emitting element and an assembly structure of light-guiding cover. The assembly structure of light-guiding cover comprises a casing and a light-guiding cover. The casing has a receiving recess and a first engaging groove and a second engaging groove opposite to the first engaging groove, the light-emitting element is disposed within the receiving recess, and the first engaging groove and the second engaging groove are located at opposite two sides of the receiving recess. The light-guiding cover covers the receiving recess and has at least one aperture corresponding to the light-emitting element, wherein the light-guiding cover comprises a first engaging sheet and a second engaging sheet. The first engaging sheet is engaged with the first engaging groove. The second engaging sheet is disposed opposite to the first engaging sheet and engaged with the second engaging groove.

The above and other aspects of the invention will become better understood with regard to the following detailed description of the preferred but non-limiting embodiments). The following description is made with reference to the accompanying drawings.

DETAILED DESCRIPTION OF THE PREFERRED EMBODIMENTS

Figure 1:
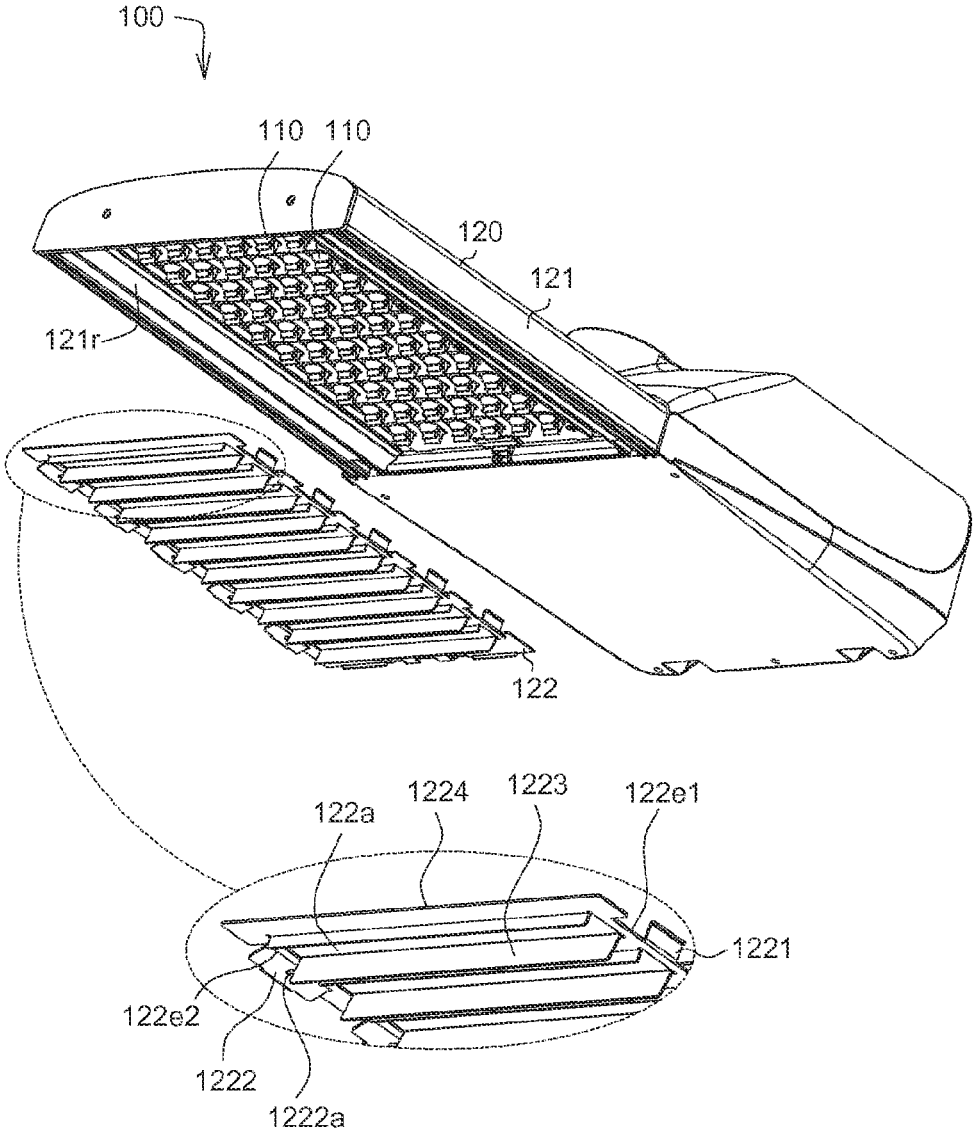
FIG. 1 illustrates an exploded diagram of a lighting device according to an embodiment of the invention.

Referring to FIG. 1, an exploded diagram of a lighting device according to an embodiment of the invention is illustrated. The lighting device 100 can be applied to a streetlamp, a table lamp or other lighting product. The lighting device 100 comprises at least one light-emitting element 110 and an assembly structure of light-guiding cover 120. The light-emitting elements 110, such as light-emitting diode (LED) or other suitable light source, are disposed within the assembly structure of light-guiding cover 120. The assembly structure of light-guiding cover 120 comprises a casing 121 and a light-guiding cover 122. The casing 121 has a receiving recess 121*r* within which the light-emitting elements 110 are disposed. The light-guiding cover 122 is assembled in the casing 121 through way of engaging; accordingly, an assembly speed, detachment speed and convenience can be promoted.

When the lighting device 100 is street lamp, the assembly structure of light-guiding cover 120 is generally disposed in a height of ten meters. In traditional design, the light-guiding cover is assembled to the casing by several screws, and if the light-guiding cover is required to be detached, worker needs to time-consumingly and laboriously loosen several screws to detach a front cover of the street lamp, and then assemble the light-guiding cover to the casing by several screws. Such time-consuming and laborious work results in inconvenient and danger of operating in aerial working for worker.

Figure 2:
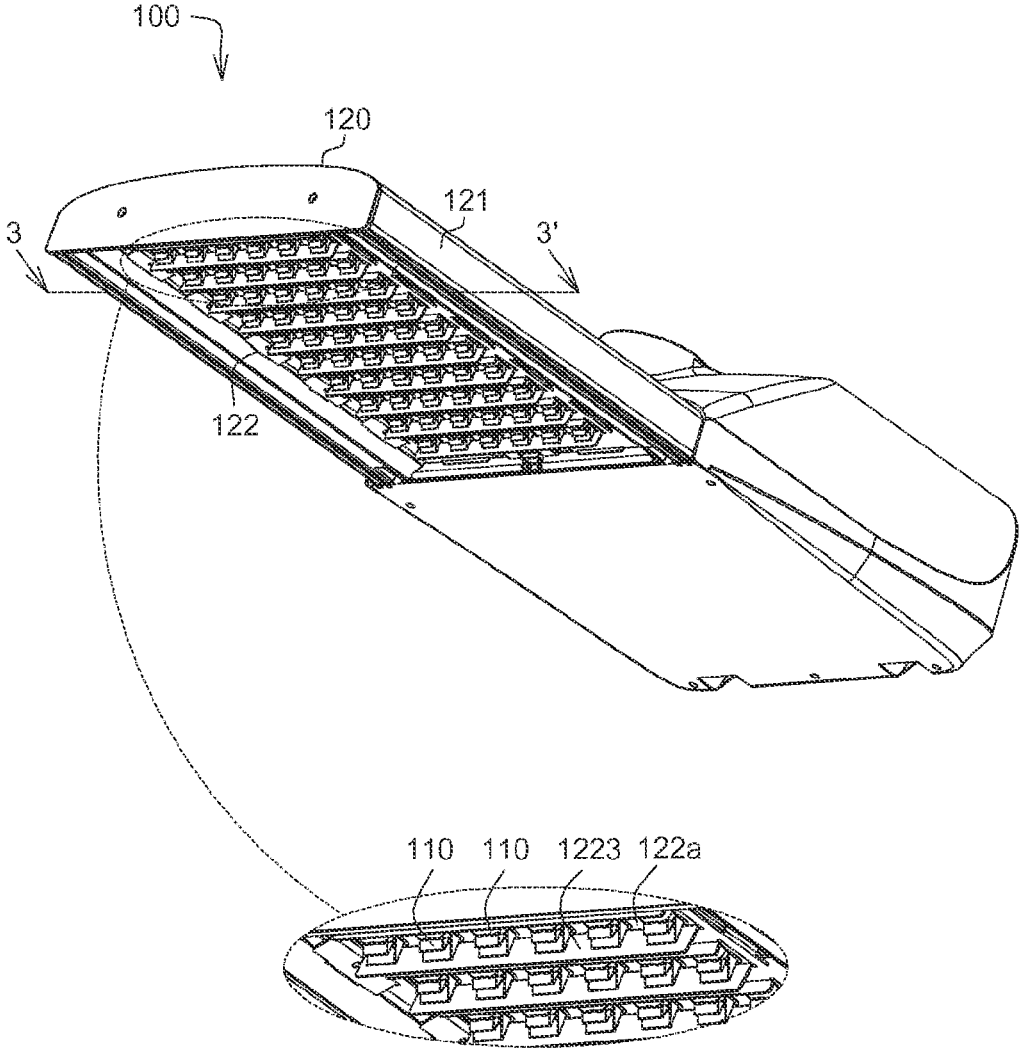
FIG. 2 illustrates an assembly diagram of the assembly structure of light-guiding cover being assembled to the casing.

Referring to FIG. 2, an assembly diagram of the assembly structure of light-guiding cover being assembled to the casing is illustrated. The light-guiding cover 122 of the lighting device 100 of present embodiment of this invention can be assembled to the casing 121 by way of engaging, such that the light-guiding cover 122 can be rapidly assembled to the casing 121 and detached from the casing 121. As a result, assembly time and danger can be reduced. In addition, since the light-guiding cover 122 is assembled to the casing 121 by way of engaging, the light-guiding cover 122 can be detached without tool; however, such exemplification not meant to be limiting.

Referring to FIGS. 1 and 2, the light-guiding cover 122 can cover casing 121 and has at least one aperture 122*a*. When the light-guiding cover 122 is assembled to the casing 121, the apertures 122*a* corresponds to the light-emitting elements 110, such that light emitted from the light-emitting elements 110 can emit outward through the apertures 122*a*. One aperture 122*a* corresponds at least one portion of all light-emitting elements 110. In present embodiment, each aperture 122*a* corresponds to some of all light-emitting elements 110. In another embodiment, each aperture 122*a* corresponds to one light-emitting element 110. The light-guiding cover 122 comprises at least one light-guiding sheet 1223 connected to an edge of the aperture 122*a*. The light-guiding sheet 1223 is located adjacent to one side of the light-emitting element 110 to reflect light emitted from the light-emitting elements 110, such that the lighting region of the lighting device 100 can be changed. In addition, the lighting region of the lighting device 100 can be also changed by changing a height, a length and an angle of the light-guiding sheet 1223.

Figure 3:
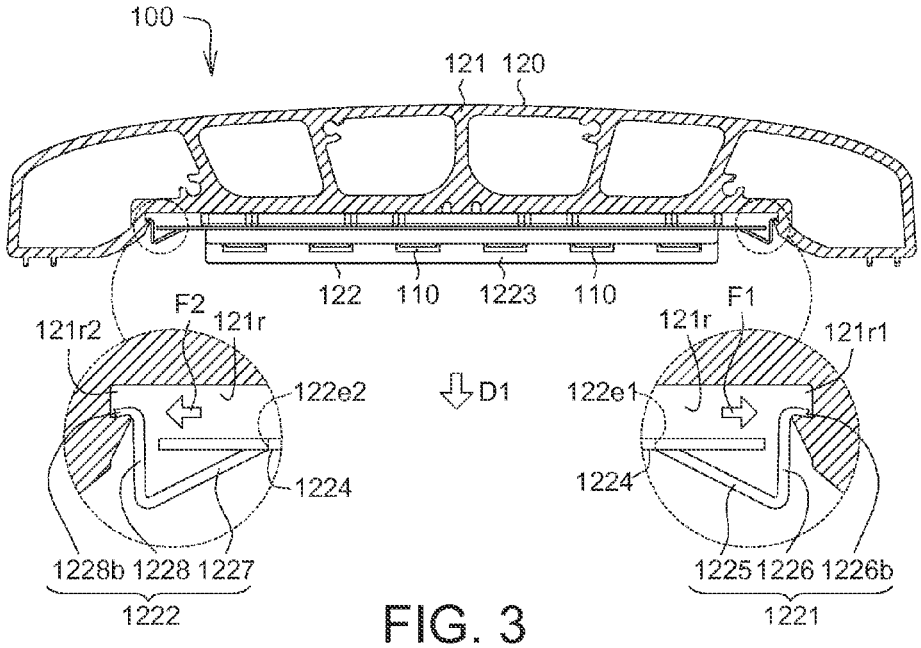
FIG. 3 illustrates a cross-sectional view of assembly structure of light-guiding cover viewed along a direction 3-3' of FIG. 2.

Referring to FIG. 3, a cross-sectional view of assembly structure of light-guiding cover viewed along a direction 3-3' of FIG. 2 is illustrated. The casing 121 has at least one first engaging groove 121*r*1 and at least one second engaging groove 121*r*2, wherein the first engaging groove 121*r*1 and the second engaging groove 121*r*2 are located at opposite two sides of receiving recess 121*r* and interconnected with receiving recess 121*r*. The light-guiding cover 122 comprises at least one first engaging sheet 1221 and at least one second engaging sheet 1222, wherein the first engaging sheet 1221 is engaged with the first engaging groove 121*r*1, and the second engaging sheet 1222 is engaged with the second engaging groove 121*r*2. By the design of the engaging groove and the engaging sheet, the light-guiding cover 122 can be rapidly engaged with the casing 121 to be rapidly assembled to and detached from the casing 121. In an embodiment, each of the first engaging groove 121*r*1 and the second engaging groove 121*r*2 is a strip-shaped groove with which the engaging sheets of the light-guiding cover 122 are engaged.

The light-guiding cover 122 is made from metal, such as aluminum, or plastic, such as a white plastic or a reflexible plastic. In an embodiment, when the light-guiding cover 122 is made from metal, the light-guiding cover 122 can be formed by pressing and/or bending a sheet metal. The light-guiding cover 122 has flexible property because of way of pressing and/or bending. In another embodiment, when the light-guiding cover 122 is made from plastic, the light-guiding cover 122 can be formed by injection molding. In an embodiment, the first engaging sheet 1221, the second engaging sheet 1222, the apertures 122*a* and the light-guiding sheets 1223 can regularly arranged in a light-guiding cover with an arbitrary length; under the circumstances, the light-guiding cover 122 with suitable length capable to assembling to the casing 121 can be obtained by cutting the light-guiding cover with the arbitrary length.

In present embodiment, the light-guiding cover 122 comprises a sheet body 1224 having a first edge 122*e*1 (also illustrated in FIG. 1) and a second edge 122*e*2 (also illustrated in FIG. 1), wherein several first engaging sheets 1221 are arranged in the first edge 122*e*1, and several second engaging sheets 1222 are arranged in the second edge 122*e*2; however, such exemplification not meant to be limiting. As long as the light-guiding cover 122 can be engaged with the casing 121, the first engaging sheets 1221 and the second engaging sheets 1222 can be disposed on an arbitrary position of the sheet body 1224.

In present embodiment, the first engaging sheet 1221 and the second engaging sheet 1222 are extended outward from the first edge 122*e*1 and the second edge 122*e*2 respectively. In detail, the first engaging sheet 1221 comprises a first extension 1225 and a second extension 1226, wherein the first extension 1225 is extended outward from the first edge 122*e*1 and toward a light-emitting direction D1 of the lighting device 100, and the second extension 1226 is extended toward the first engaging groove 121*r*1 from the first extension 1225 to an inside of the first engaging groove 121*r*1, such that the second extension 1226 can be engaged within first engaging groove 121*r*1. In present embodiment, an end of the second extension 1226 has a bending portion 1226*b* extended toward the inside of the first engaging groove 121*r*1 to be engaged within the inside of the first engaging groove 121*r*1.

Due to the bending-shaped first engaging sheet 1221, the first engaging sheet 1221 has flexible property and elastic property. When the second extension 1226 is engaged with the first engaging groove 121*r*1, a first elastic recovery force F1 is provided to the casing 121, such that the light-guiding cover 122 is not easy to be detached from the casing 121. When the light-guiding cover 122 is assembled to the casing 121, the light-guiding cover 122 is detached as long as the first elastic recovery force F1 is conquered to release the bending portion 1226*b* of the second extension 1226 from the first engaging groove 121*r*1.

Similarly, the second engaging sheet 1222 comprises a third extension 1227 and a fourth extension 1228, wherein the third extension 1227 is extended outward from the second edge 122*e*2 and toward the light-emitting direction D1 of the lighting device 100, and the fourth extension 1228 is extended toward the second engaging groove 121*r*2 from the third extension 1227 to an inside of the second engaging groove 121*r*2, such that the fourth extension 1228 can be engaged within second engaging groove 121*r*2. In present embodiment, an end of the fourth extension 1228 has a bending portion 1228*b* extended toward the inside of the second engaging groove 121*r*2 to be engaged within the inside of the second engaging groove 121*r*2.

Due to the bending-shaped second engaging sheet 1222, the second engaging sheet 1222 has flexible property and elastic property. When the fourth engaging sheet 1228 is engaged with the second engaging groove 121*r*2, a second elastic recovery force F2 is provided to the casing 121, such that the light-guiding cover 122 is not easy to be detached from the casing 121. When the light-guiding cover 122 is assembled to the casing 121, the light-guiding cover 122 is detached as long as the second elastic recovery force F2 is conquered to release the bending portion 1228*b* of the fourth extension 1228 from the second engaging groove 121*r*2.

Since the first engaging sheet 1221 and the second engaging sheet 1222 are disposed opposite to each other, such that the first elastic recovery force F1 and the second elastic recovery force F2 are applied to the casing 121 toward opposite two directions respectively; accordingly, the combination between the light-guiding cover 122 and the casing 121 is increased.

Figure 4:
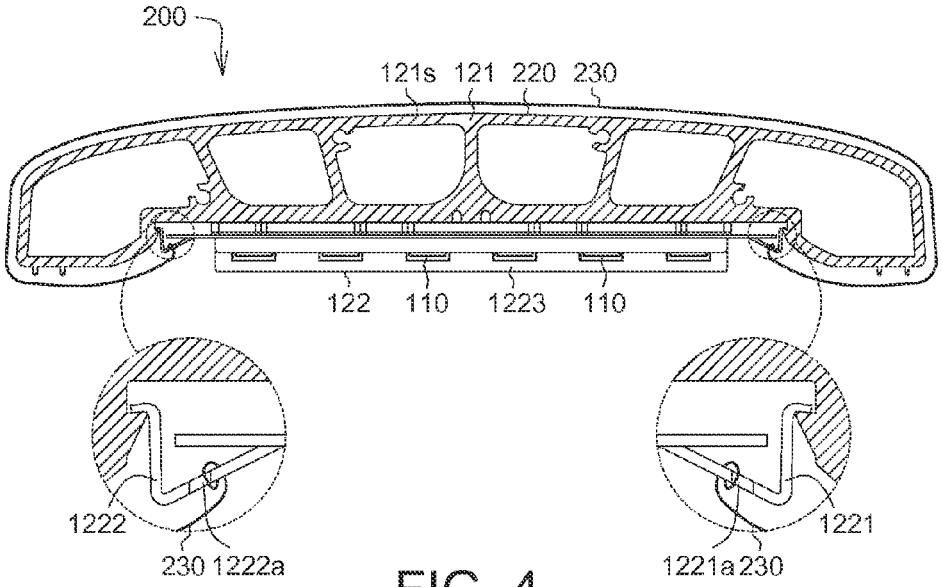
FIG. 4 illustrates a cross-sectional view of a lighting device according to another embodiment.

Referring to FIG. 4, a cross-sectional view of a lighting device according to another embodiment is illustrated. The lighting device 200 comprises at least one light-emitting element 110, the assembly structure of light-guiding cover 120 and an anti-drop element 230. The assembly structure of light-guiding cover 120 comprises the casing 121 and the light-guiding cover 122. In present embodiment, the first engaging sheet 1221 and the second engaging sheet 1222 have a first through hole 1221*a* and a second through hole 1222*a* respectively. The anti-drop element 230 is connected to the first through hole 1221*a* and the second through hole 1222*a* to prevent the light-guiding cover 122 from dropping from the casing 121. Furthermore, the anti-drop element 230 is a wire structure, such as a metal wire, a wire made from a high polymer or a wire structure made other material. The wire structure passes through an outer surface 121*s* of the casing 121, and two ends of the wire structure are connected to the first through hole 1221*a* and the second through hole 1222*a* respectively, such that the light-guiding cover 122 and the casing 121 are combined together. As a result, after the first engaging sheet 1221 and the second engaging sheet 1222 are detached from first engaging groove 121*r*1 and the second engaging groove 121*r*2 (such as, detachment and assembly operation in aerial working), the light-guiding cover 122 is avoided to fall to the ground. In addition, the wire structure passing through the outer surface 121*s* of the casing 121 can touch the outer surface 121*s* or may be avoided touching the outer surface 121*s*.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An assembly structure of light-guiding cover used in a lighting device that includes a light-emitting element, the assembly structure of light-guiding cover comprising:

a casing having a receiving recess and a first engaging groove and a second engaging groove opposite to the first engaging groove, wherein the light-emitting element is disposed within the receiving recess, and the first engaging groove and the second engaging groove are located at opposite two sides of the receiving recess; and a light-guiding cover covering the receiving recess and having at least one aperture corresponding to the light-emitting element, wherein the light-guiding cover comprises:

a first engaging piece engaging with the first engaging groove; and a second engaging piece is disposed opposite to the first engaging piece and engaged with the second engaging groove.

2. The assembly structure of light-guiding cover according to claim 1, wherein the light-guiding cover is a flexible light-guiding cover.

3. The assembly structure of light-guiding cover according to claim 1, wherein the light-guiding cover comprises:

a sheet body having a first edge and a second edge opposite to the first edge, wherein the first engaging piece and the second engaging piece are extended outward from the first edge and the second edge, respectively.

4. The assembly structure of light-guiding cover according to claim 3, wherein the first engaging piece comprises:

a first extension extended toward a light-emitting direction of the lighting device from the first edge; and a second extension extended toward the first engaging groove from the first extension to an inside of the first engaging groove.

5. The assembly structure of light-guiding cover according to claim 3, wherein the second engaging piece comprises:

a third extension extended toward a light-emitting direction of the lighting device from the second edge; and a fourth extension extended toward the second engaging groove from the third extension to an inside of the second engaging groove.

6. The assembly structure of light-guiding cover according to claim 1, wherein the first engaging piece and the second engaging piece have a first through hole and a second through hole respectively, and the assembly structure of light-guiding cover further comprises:

an anti-drop element connected to the first through hole and the second through hole.

7. The assembly structure of light-guiding cover according to claim 6, wherein the anti-drop element is a wire structure, and two end of the wire structure passing through an outer surface of the casing are connected to the first through hole and the second through hole respectively.

8. The assembly structure of light-guiding cover according to claim 1, wherein the lighting device comprises a plurality of the light-emitting element, and the aperture corresponds at least one portion of the light-emitting elements.

9. A lighting device comprising:

a light-emitting element; and an assembly structure of light-guiding cover comprising:

a casing having a receiving recess and a first engaging groove and a second engaging groove opposite to the first engaging groove, the light-emitting element is disposed within the receiving recess, and the first engaging groove and the second engaging groove are located opposite two sides of the receiving recess; and a light-guiding cover covering the receiving recess and having at least one aperture corresponding to the light-emitting element, wherein the light-guiding cover covering comprises:

a first engaging piece engaging with the first engaging groove; and a second engaging piece is disposed opposite to the first engaging piece and engaging with the second engaging groove.

10. The lighting device according to claim 9, wherein the light-guiding cover is a flexible light-guiding cover.

11. The lighting device according to claim 9, wherein the light-guiding cover comprises:

a sheet body having a first edge and a second edge opposite to the first edge, wherein the first engaging piece and the second engaging piece are extended outward from the first edge and the second edge respectively.

12. The lighting device according to claim 11, wherein the first engaging piece comprises:

a first extension extended toward a light-emitting direction of the lighting device from the first edge; and a second extension extended toward the first engaging groove from the first extension to an inside of the first engaging groove.

13. The lighting device according to claim 11, wherein the second engaging piece comprises:

a third extension extended toward a light-emitting direction of the lighting device from the second edge; and a fourth extension extended toward the second engaging groove from the third extension to an inside of the second engaging groove.

14. The lighting device according to claim 9, wherein the first engaging piece and the second engaging piece have a first through hole and a second through hole respectively, and the assembly structure of light-guiding cover further comprises:

an anti-drop element connected to the first through hole and the second through hole.

15. The lighting device according to claim 14, wherein the anti-drop element is a wire structure, and two end of the wire structure passing through an outer surface of the casing are connected to the first through hole and the second through hole respectively.

16. The lighting device according to claim 9, wherein the lighting device comprises a plurality of the light-emitting element, and the aperture corresponds at least one portion of the light-emitting elements.

* * * * *